US006417829B1

(12) United States Patent
Jung et al.

(10) Patent No.: US 6,417,829 B1
(45) Date of Patent: Jul. 9, 2002

(54) MULTISYNC DISPLAY DEVICE AND DRIVER

(75) Inventors: Byung-Hoo Jung; Ho-Hyeong Lee, both of Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 191 days.

(21) Appl. No.: 09/585,430

(22) Filed: Jun. 2, 2000

(30) Foreign Application Priority Data

Jun. 3, 1999 (KR) ..... 99-20521

(51) Int. Cl.[7] ..... G09G 3/36
(52) U.S. Cl. ..... 345/98; 345/100; 345/213
(58) Field of Search ..... 345/98, 100, 213

(56) References Cited

U.S. PATENT DOCUMENTS 5,889,504 A * 3/1999 Kihara et al. ..... 345/100
5,990,857 A * 11/1999 Kubota et al. ..... 345/98

* cited by examiner

*Primary Examiner*—Richard Hjerpe
*Assistant Examiner*—Jennifer T. Nguyen
(74) *Attorney, Agent, or Firm*—McGuireWoods LLP

(57) ABSTRACT

The present invention modifies LCD panel display modes with a simple circuit configuration. When a driving frequency is supplied that does not drive all the configured pixels, the present invention drives all the pixels according to a multisync mode. The present invention comprises a LCD panel including a plurality of gate lines, a plurality of data lines, and a plurality of TFTs each having a gate electrode connected to the gate line and having a source electrode connected to the data line; a data driver receiving four driving clock signals and performing a multisync function on the driving frequency; a gate driver receiving four shift clock signals and performing multisync function on the driving frequency; and a timing controller outputting four driving clock signals and shift clocks and changing and outputting the status of the four driving clock signal and the shift clocks according to the normal mode or multisync mode.

40 Claims, 11 Drawing Sheets

MULTISYNC DISPLAY DEVICE AND DRIVER

BACKGROUND OF THE INVENTION (a) Field of the Invention

The present invention relates to a scanning driver of a display device. More specifically, the present invention relates to a gate driver of a poly-silicon thin film transistor liquid crystal display (TFT-LCD) having a number of pixels.

(b) Description of the Related Art

In a TFT-LCD, an electric field is supplied to a liquid crystal layer having an anisotropic permittivity that is injected in between two panels, and the amount of light that permeates the panels is adjusted by controlling the strength of the electric field, and thereby obtaining desired pixel signals.

A TFT-LCD has a predetermined number of pixels depending on desired resolutions. Resolutions are categorized as an extended Graphics Array (XGA) with 1024×768 pixels, a Super Video Graphics Array (SVGA) with 800×600 pixels, and a Video Graphics Array (VGA) with 640×480 pixels. Hence, each TFT-LCD with a different resolution has a different driving frequency that drives a predetermined number of pixels.

When a TFT-LCD shows images of different signal formats using a fixed number of pixels, it is referred to as a multisync function.

For office automation (OA) products, the XGA device additionally supports SVGA or VGA formats to provide such a multisync function. For audio and video (ANV) products, video signal formats are categorized into the National Television System Committee (NTSC) format and the Phase Alternating by Line system (PAL) format, and display modes are categorized into a full mode, a wide mode, a normal mode, and a cinema mode.

However, unlike amorphous silicon LCDs, when implementing the multisync function in poly-silicon TFT-LCDs that integrates a drive circuit, the circuit becomes complex, decreasing the yield of the LCD panels and increasing the panel size.

SUMMARY OF THE INVENTION

It is an object of the present invention to implement the multisync function using a simple circuit configuration and improve the yield of liquid crystal display (LCD) device panels.

In one aspect of the present invention, an LCD device comprises an LCD panel including a plurality of gate lines, a plurality of insulated data lines crossed with the gate lines, and a plurality of thin-film transistors (TFTs) each including a gate electrode connected to a gate line, and a source electrode connected to a data line; a data driver supplying per line a gray image voltage through the data lines; a gate driver including a plurality of first blocks each receiving a first and second clock signal, and a plurality of second blocks each receiving a third and fourth clock signal, the first and second blocks each including a predetermined number of latch blocks connected in series, and in a multisync mode, concurrently outputting a plurality of gate driving signals to a plurality of gate lines for a period determined by the predetermined number of the latch blocks; and a timing controller outputting a first clock signal, a second clock signal that is an inverted first clock signal, a third clock signal, and a fourth clock signal that is an inverted third clock signal, and changing the status of the first through fourth clock signals according to normal or multisync modes.

The gate driver comprises a shift register unit in which first and second blocks are alternately connected in series; and a logical arithmetic unit including a plurality of logical arithmetic blocks that receives outputs of an (n)th latch block and an (n+1)th latch block and performs a logical arithmetic operation, with each output terminal of the logical arithmetic block including a logical arithmetic means connected to a corresponding gate line.

The first or second block is characterized in that at least in the multisync mode the outputs of the latch blocks positioned in the first and second places are identical with the output of the last latch block of a previous block.

The shift register unit is characterized in that the first and last blocks each include two latch blocks and other blocks include four latch blocks.

The latch block, a shift register, comprises a first three-phase inverter operative according to the first or third clock signals; an inverter having an input terminal connected to an output terminal of the first three-phase inverter; and a second three-phase inverter having an input terminal connected to an output terminal of the inverter, and having an output terminal connected to the input terminal of the inverter, and operating according to the second or fourth clock signals.

The logical arithmetic block is an AND gate.

The logical arithmetic block comprises an AND gate performing a logical AND operation on outputs of the (n)th and (n+1)th latch blocks; a first inverter inverting an output of the logical AND gate; and a second inverter inverting an output of the first inverter.

The timing controller is characterized in that the first and third clock signals are identical and the second and fourth clock signals are identical in the normal mode, and the first and fourth clock signals are identical and the second and third clock signals are identical in the multisync mode.

BRIEF DESCRIPTION OF THE DRAWINGS

The accompanying drawings, which are incorporated in and constitute a part of the specification, illustrate embodiments of the invention, and, together with the description, serve to explain the principles of the invention.

DETAILED DESCRIPTION OF THE PREFERRED EMBODIMENTS

In the following detailed description, only the preferred embodiments of the invention have been shown and described, simply by way of illustrating the best mode contemplated by the inventors of carrying out the invention. As will be realized, the invention is capable of modification in various obvious respects, all without departing from the invention. Accordingly, the drawings and description are to be regarded as illustrative in nature, and not restrictive.

A TFT-LCD to implement the multisync function according to the first aspect of the present invention will be described. The TFT-LCD according to the first aspect of the present invention performs the cinema mode display as a multisync function.

Figure 1:
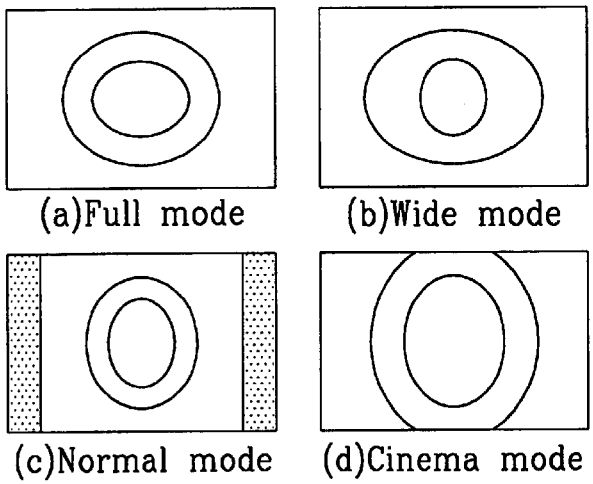
FIG. 1 represents the state of a TFT-LCD screen per its display mode.

FIG. 1 shows the status of a screen for the display modes of the TFT-LCD. FIG. 1 (*a*) is a full mode that extends an image of an aspect ratio of 4:3 horizontally into an aspect ratio of 16:9. FIG. 1 (*b*) is a wide mode in which the enlargement ratio increases as it goes from the center of the image to the boundary of the image in a horizontal direction. FIG. 1 (*c*) is a normal mode that enlarges the image to fit a 4:3 aspect ratio, leaving the remainder black. FIG. 1 (*d*) is a cinema mode that arranges predetermined upper and lower parts of the image to be removed and the enlarged 4:3 aspect ratio image to fit into a display with the aspect ratio of 16:9 in width, and removes the remaining upper and lower parts of the image. The full mode, the wide mode and the normal mode differ in the number of data lines to display images while using the same number of gate lines for all three modes. On the other hand, the cinema mode uses different number of gate lines to display images.

The present invention can implement the cinema mode.

Figure 2:
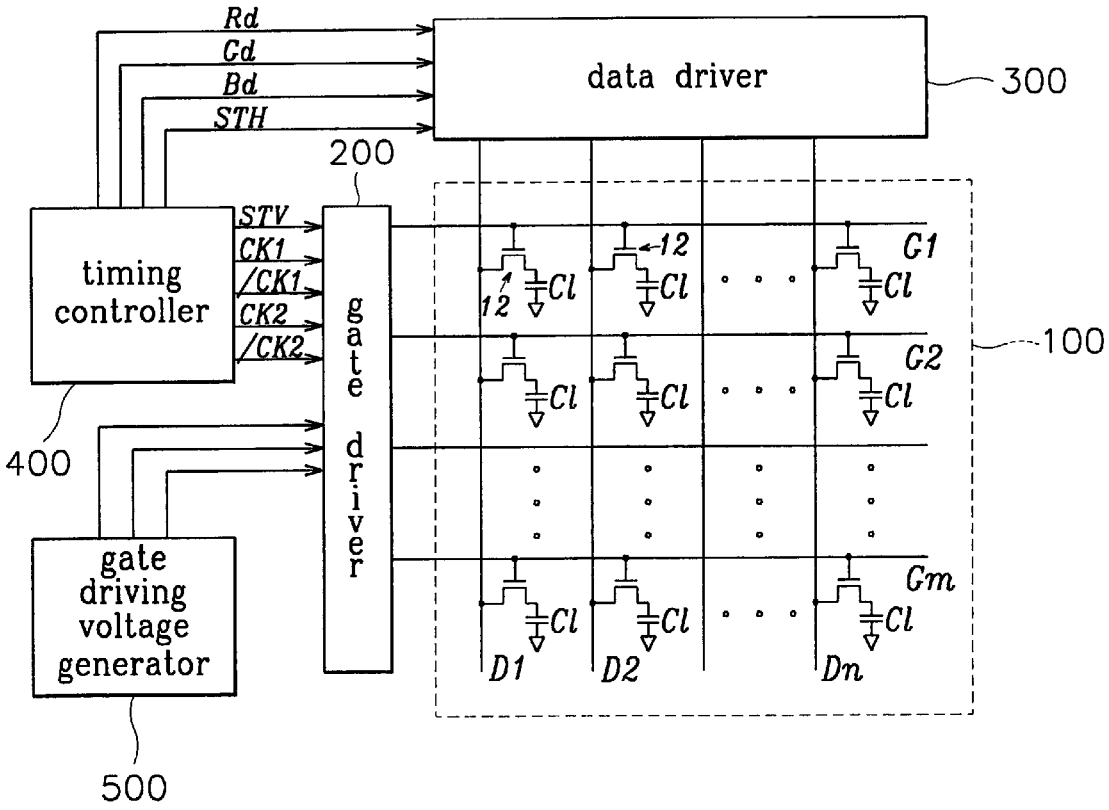
FIG. 2 is a block diagram of the TFT-LCD according to a preferred embodiment of the present invention.

FIG. 2 shows a block diagram of the TFT-LCD according to a preferred embodiment of the present invention. As shown, the TFT-LCD comprises an LCD panel 100, a gate driver 200, a data driver 300, a timing controller 400, and a gate driving voltage generator 500.

A plurality of gate lines G1, G2, . . . , Gm and a plurality of data lines D1, D2, . . . , Dn insulated from and crossing the gate lines are formed on the LCD panel 100. A thin film transistor (TFT) is respectively formed in each pixel, an area surrounded by the gate lines and data lines.

A gate electrode, a source electrode, and a drain electrode of the TFT are respectively coupled to the gate line, the data line, and the pixel electrode (not shown). Liquid crystal is injected between the pixel element and a panel on which a common electrode is formed. The liquid crystal can equivalently be represented as a capacitor C1.

The timing controller 400 outputs to the gate driver 200 a first clock signal CK1, a second clock signal /CK1 that is an inverted first clock signal CK1, a third clock signal CK2, and a fourth clock signal /CK2 that is an inverted third clock signal CK2.

The gate driver 200 supplies to the gate line a gate on/off voltage for turning the TFTs on or off. At this time, the 'gate on' voltage is sequentially supplied to the gate lines of the LCD panel, and accordingly, the TFTs coupled to the gate line to which the gate on voltage is supplied are turned on.

Figure 3:
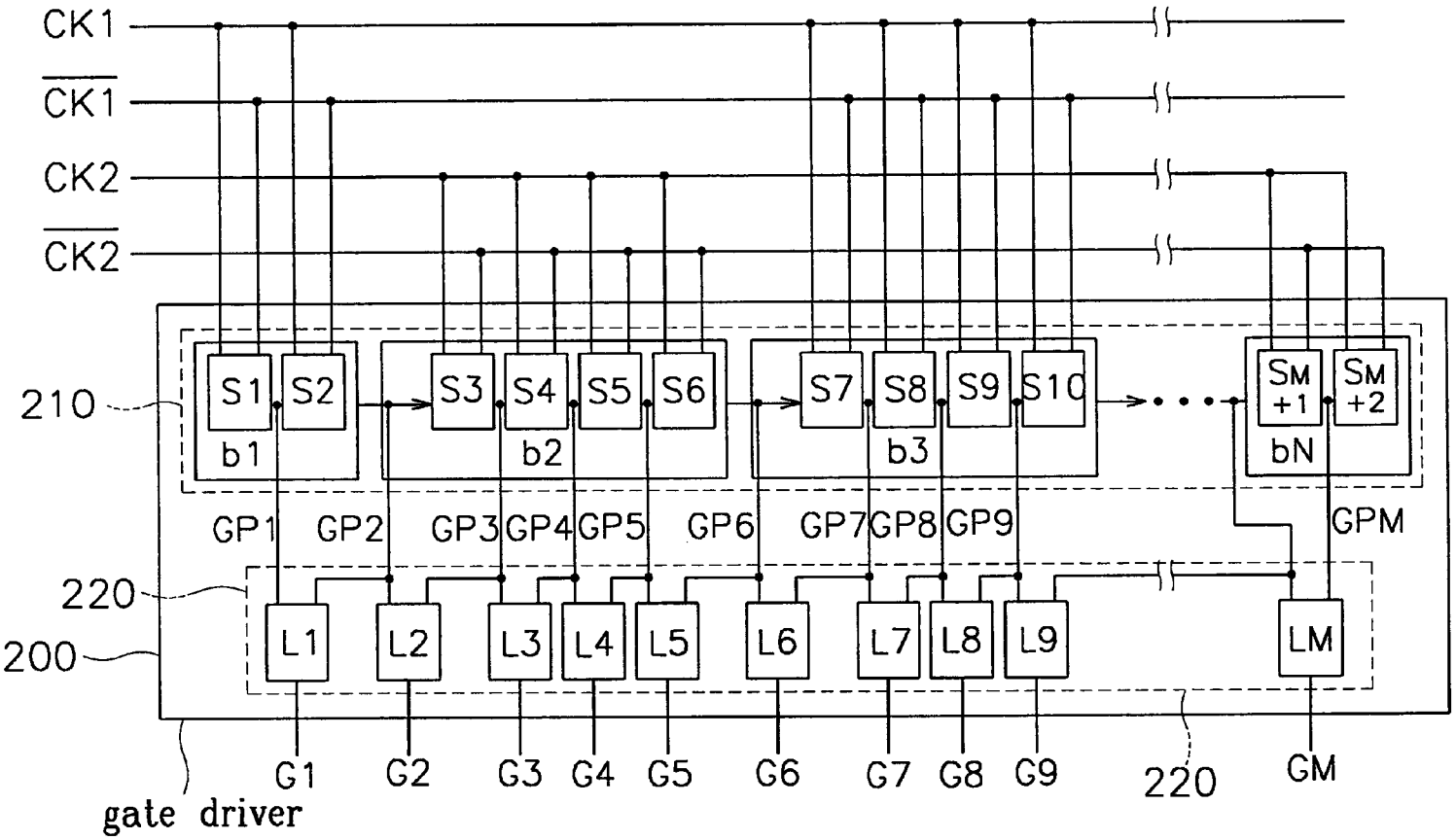
FIG. 3 is a block diagram of a gate driver of the TFT-LCD according to a first aspect of the present invention.

As represented in FIG. 3, the gate driver 200 comprises first block groups that receive the first clock signal CK1 and the second clock signal /CK1, and second block groups that receive the third clock signal CK2 and the fourth clock signal /CK2. The first block groups and the second block groups are alternately connected in series. At this time, the first block groups are positioned at every odd position with the second block groups in the even positions.

The data driver 300 supplies to each data line gray voltage signals. At this time, when the gate lines are sequentially driven, the gray voltage is sequentially supplied to each data line. The same gray voltages are supplied to the TFTs that are connected to the concurrently driven gate lines.

The timing controller 400 outputs to the data driver 300 driving clock signals, red, green and blue (R, G, and B) data signals Rd, Gd, and Bd, and a data driving start signal STH. It also outputs to the gate driver 200 the first clock signal CK1, the second clock signal /CK1, the third clock signal CK2, the fourth clock signal /CK2 and a gate driving start signal STV.

Hence, the gate driver 200 receives the first through fourth clock signals CK1, /CK1, CK2, and /CK2 from the timing controller 400, and receives the gate on/off voltage from the gate driving voltage generator 500.

When the first clock signal CK1 is identical to the third clock signal CK2 and the second clock signal /CK1 is identical to the fourth clock signal /CK2 of the timing controller 400, the gate driver 200 of the first preferred embodiment drives the gate line in the full mode, in the wide mode, or in the normal mode. That is, the gate driver 200 drives one gate line for one clock signal of the input gate driving signal.

On the other hand, when the supplied first clock signal CK1 is identical to the fourth clock signal /CK2 and the supplied second clock signal /CK1 is identical to the third clock signal CK2, the gate driver 200 operates in the cinema mode. That is, the gate driver 200 receives one gate driving clock signal for one predetermined cycle so as to provide a 'gate on' signal for two gate lines. Here, the predetermined cycle is defined as a predetermined number of gate driving clock signals. For example, if five gate driving clock signals are set as one cycle, a specific gate driving clock signal of the first five gate driving clock signals (the first through fifth gate driving clock signals) concurrently drives two gate lines, and another specific gate driving clock signal in the next five gate driving clock signals (the sixth through the tenth gate driving clock signals) concurrently drives two gate lines. That is, in this case it can be said that every Pth gate driving clock signal concurrently drives two gate lines, where P equals 5 (the number of gate driving clock signals in one cycle)×n (0, 1, 2, 3, . . . )+m (1, 2, 3, 4, 5),. Here, the number of the gate driving clock signals forming a cycle is determined by the number of the gates, and the m can be modified by the manufacturer's specification.

In the above gate driving method for the cinema mode, the data driver concurrently provides identical R, G, and B data signals to the gate line that is being concurrently driven so as to implement the cinema mode.

An operation of the gate driver for implementing the cinema mode will now be described referring to FIG. 3.

FIG. 3 shows a block diagram of the gate driver 200 of the TFT-LCD according to a first aspect of the present invention. As shown, the gate driver of the TFT-LCD according to the first aspect of the present invention applied to a poly-silicon TFT-LCD that comprises a shift register unit that receives four clock signals CK1, /CK1, CK2, and /CK2, and a logic arithmetic unit 220.

The shift register unit 210 includes (M/4+1) number of shift blocks b1, b2, . . . , bN connected in series.

Here, the first shift block b1 comprises two shift registers S1 and S2 connected in series, and the last shift block bN comprises two shift registers SM+1 and SM+2, and other shift blocks comprise four shift registers connected in series. The total number of the shift registers forming the shift blocks is one more than the total number of the gate lines.

The shift registers, of the odd numbered shift blocks b1, b3, . . . receive the clock signals CK1 and /CK1, and the shift registers, of the even numbered shift blocks b2, b4, . . . receive the clock signals CK2 and /CK2. The shift registers respectively output the values of GP1, GP2, . . . , or GPM.

The logic arithmetic unit 220 includes logic arithmetic blocks L1, L2, . . . , LM, where M is the number of the gate lines, and the two input terminals of each block L1, L2, . . . , LM are connected to a corresponding output terminal of a shift register and to an output terminal of a neighboring shift register of the shift register unit 210, and the output terminal of each logic arithmetic block is respectively connected to each gate line G1, G2, . . . , GM.

The gate driver 200 according to the first aspect of the present invention generates gate driving start signals for the full mode, the wide mode and the normal mode, when it receives the first clock signal CK1 identical to the third clock signal CK2 and the second clock signal /CK1 identical to the fourth clock signal /CK2, along with the gate driving start signal STV (not illustrated in FIG. 3).

On the other hand, this invention can be used as a scanning driver of a display apparatus including a plurality of scanning lines and a plurality of data lines insulated from and crossing the scanning lines and transmitting image signals. In this case, the signals output from the logic arithmetic unit 220 are scanning signals for the scanning lines. Here, a scanning driver, having a configuration as shown in FIG. 3, has a configuration identical to the gate driver.

Hence, the configuration and the operation of the shift register 210 and the logic arithmetic unit 220 to be described below are the same as those of the gate driver and the scanning driver. Therefore, the operation of the scanning driver will be described together with that of the gate driver.

Figure 4:
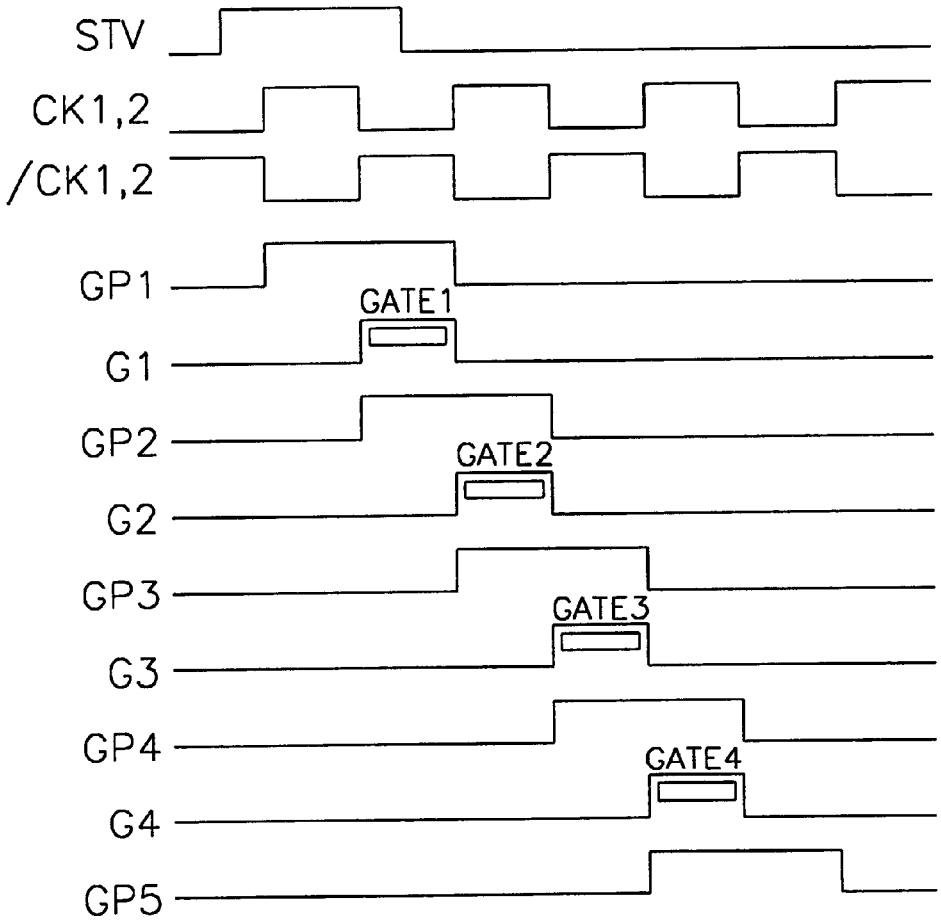
FIG. 4 is a timing diagram of clock signals supplied to the gate driver of FIG. 3 in the wide, normal, and full modes.
Figure 5:
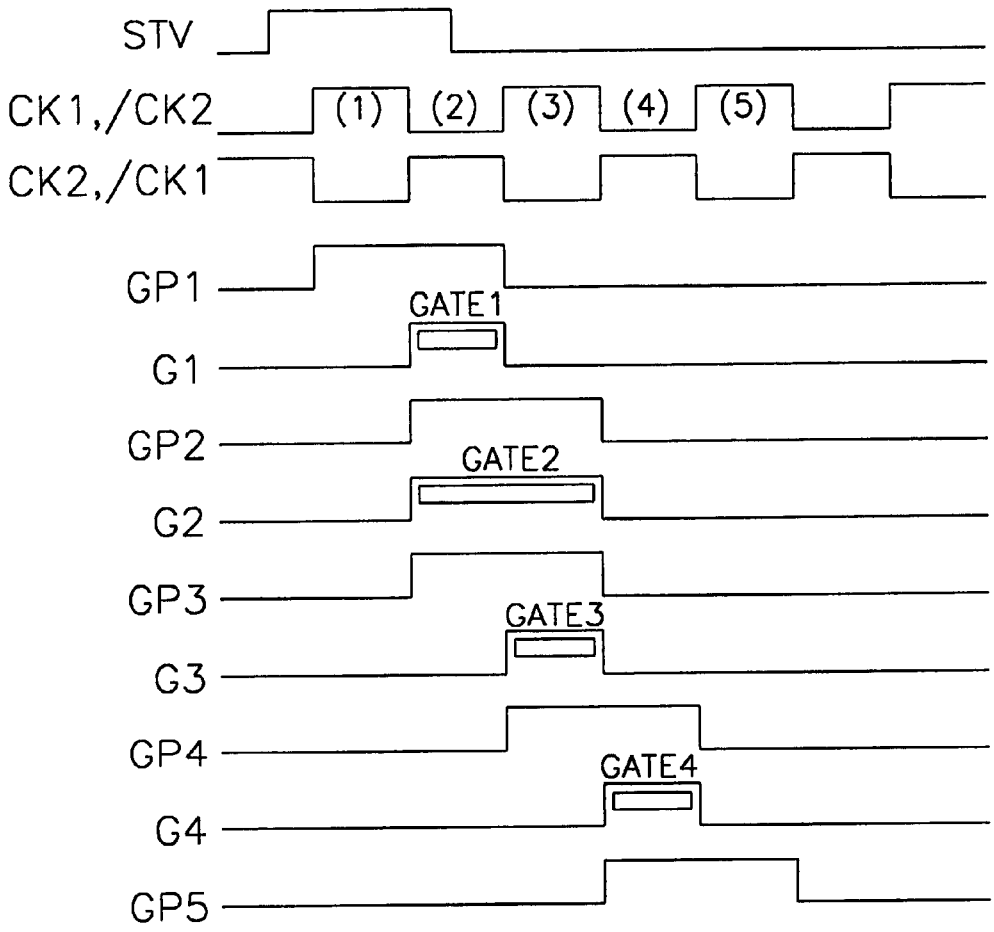
FIG. 5 is a timing diagram of clock signals supplied to the gate driver of FIG. 3 in the cinema mode.

FIG. 4 shows a timing diagram of the clocks supplied to the gate driver of FIG. 3 in the wide mode, normal mode, and full mode. As shown, the clock signal CK1 is identical to the clock signal CK2, and the clock signal /CK1 is identical to the clock signal /CK2. Referring to FIGS. 4 and 5, the operation according to the first aspect of the present invention will now be described.

When an input gate driving signal STV and the clock signal CK1 are in high status, a shift register S1 of the first block b1 outputs a high output GP1 to the logic arithmetic block L1 and shift register S2. However, since the shift register S2 is not yet driven, it outputs a low output GP2 with respect to the input high signal.

When the clock signal CK1 is switched from the high state to the low state and the clock signal /CK1 is switched from the low state to the high state, the registers S1 and S2 generate high output signals GP1 and GP2. Here, since the logic arithmetic block L1 outputs high signals only when the input signals GP1 and GP2 are high, high gate driving signals are output to a first gate line G1 only in this case. Here, the register S1 generates the high signal due to the clock signal /CK1. At this time, the output of the register S2 is provided to the logic arithmetic block L2 and the shift register S3. However, since the shift register S3 at this time also outputs a low signal, the logic arithmetic block L2 outputs a low signal.

On the other hand, as the clock signal /CK1 is switched from low to high in order for the shift register S2 to output a high signal, the shift register S3 of the shift block b2 does not generate output signals. However, when the clock signal /CK1 becomes low and the clock signal CK1 becomes high, the shift register S3 generates an output signal GP3 and the logic arithmetic block L2 generates a high signal. At this time, the shift register S1 no longer generates a high signal. When the clock signal /CK2 is switched from low to high, the shift register S4 generates a high output GP4 signal and the logic arithmetic block L3 generates a high signal. However, the shift register S2 does not generate a high signal.

Therefore, each time the clock signals CK1, /CK1, CK2, and /CK2 are switched from low to high or from high to low, the shift registers S1, S2, . . . , SM+1, SM+2 perform a shift operation so as to generate high signals, and thereby, the logic arithmetic unit 220 sequentially generates gate driving signals as shown in FIG. 4.

Operations of the gate driver of an LCD and the scanning driver of a display device according to the present invention will now be described. FIG. 5 shows a timing diagram of the clock signals supplied to the date driver of FIG. 3 in the cinema mode. As shown, the clock signal CK1 is identical to the clock signal /CK2, and the clock signal /CK1 is identical to the clock signal CK2.

The shift register S1 generates an output GP1 in response to a high signal of the clock signal CK1 and outputs the signal GP1 to the shift register S2. However, since the register S2 is not driven, the register S2 does not generate a high signal, and thereby, the logic arithmetic block L1 does not generate the gate driving signal.

When the clock signal CK1 becomes low and the clock signal /CK1 becomes high, the shift register S2 generates a high output signal GP2 and provides the high signal to the shift register S3 and the logic arithmetic blocks L1 and L2.

At this time, the shift register S3 also starts to drive and provides the high output signal GP2 to the shift register S4 and the logic arithmetic blocks L2 and L3. However, at this point the shift register S4 has a low output signal GP4. Hence, the logic arithmetic block L1 outputs a high signal to the gate line G1, while the logic arithmetic block L2 does not generate a high signal.

Under this status, when the clock signals /CK2 and CK1 become high and the clocks CK2 and /CK1 become low, the registers S2, S3, and S4 generate high output signals GP2 and GP3, and thereby, the logic arithmetic blocks L2 and L3 concurrently provide the high signals to the gate lines G2 and G3.

At this time, the data signals provided to the gate lines G2 and G3 are identical. When the clocks CK1 and /CK2 become low and the clocks CK2 and /CK1 become high again, the registers S4 and S5 produce high outputs GP4 and GP5 and the logic arithmetic block L4 produces a gate control signal to the gate line G4.

Therefore, the TFT-LCD according to the first aspect of the present invention can display the cinema mode when adjusting the clock signals as shown in FIG. 5. Thus, all four modes of the normal mode, the wide mode, the full mode, and the cinema mode can be displayed.

Figure 6:
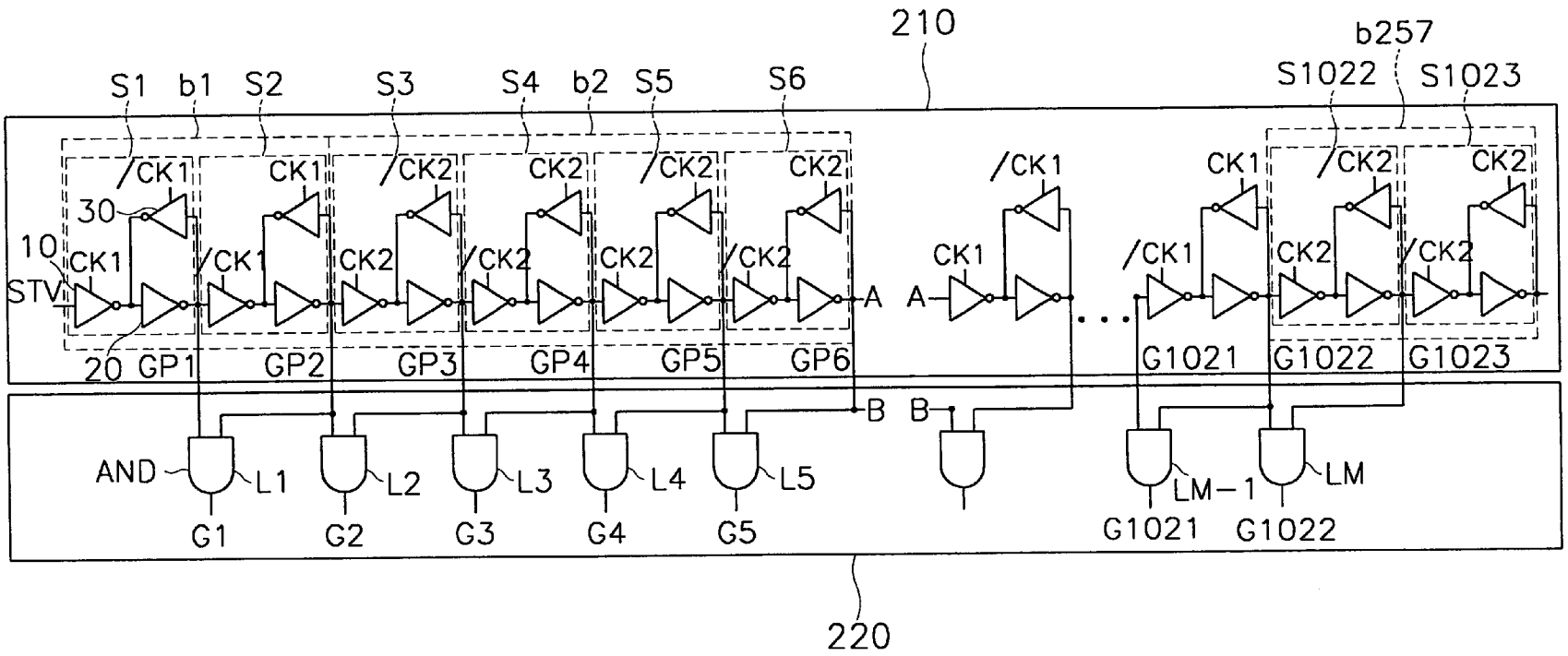
FIG. 6 is logic diagram of the first preferred embodiment to implement the gate driver of the TFT-LCD according to a first aspect of the present invention.

Referring to FIG. 6, an operation of the gate driver of the TFT-LCD, and a detailed description of FIG. 3 according to the preferred embodiment of the present invention will now be described.

FIG. 6 shows a logic diagram according to the first preferred embodiment of the present invention for implementing the gate driver of the TFT-LCD according to the present invention. As shown, the shift registers S1, S2, . . . , SM+2 respectively comprise a first three-phase inverter 10, an inverter 20 that receives an output of the first three-phase inverter 10, and a second three-phase inverter 30 that receives an output of the inverter 20 and an output terminal is connected to the inverter 20.

At this time, the three-phase inverters 10 and 30 have different driving clock signals. For the odd numbered shift blocks, the first three-phase inverter 10 uses the clock signal CK1 as the driving clock, and the second three-phase inverter 30 uses the clock signal /CK1 as the driving clock. On the other hand, for the even numbered shift blocks, the first three-phase inverter 10 uses the clock signal CK2 as the driving clock signal and the second three-phase inverter 30 uses the clock signal /CK2 as the driving clock signal.

The shift registers S1, S2, . . . , S1023 are respectively connected to the logic arithmetic blocks L1, L2, ..., LM. Here, each logic arithmetic block L1, L2, . . . , LM comprises a logical AND gate that performs a logic AND operation on two input values. That is, the AND gate has one input terminal connected to an output terminal of one shift register and has another input terminal connected to an output terminal of a neighboring shift register.

Referring to FIG. 4, an operation of the gate driver according to one aspect of the present invention in the normal mode, the wide mode, and the full mode will now be described.

When the gate driving start signal STV is supplied to the shift register S1 and the clock signal CK1 is high and the clock signal /CK1 is low, the first three-phase inverter 10 generates a low signal to supply to the inverter 20 since the clock signal CK1 is high.

The inverter 20 of the shift register S1 inverts the low signal into a high signal that is provided to the second three-phase inverter 30, AND gate L1, and the first three-phase inverter 10 of the shift register S2.

Here, since the clock signal /CK1 is low, the second three-phase inverter 30 of the shift register S1 and the first three-phase inverter 10 of the shift register S2 do not change phases. Therefore, the AND gate L1 receives a high signal from the shift register S1 and receives a low signal from the shift register S2 so as to output a low signal.

On the other hand, when the clock signal CK1 is switched from high to low, and the clock signal /CK1 from low to high, the first three-phase inverter 10 of the shift register S1 does not change phases, and thereby continues to output a low signal. At this time, the second three-phase inverter 30 of the shift register S1 starts to drive and still receives a high value of the inverter 20 before the clock signal was switched, and now outputs a low signal to the inverter 20, thereby functioning as a logic latch. Hence, the shift register S1 continues to output high signals although the clock signals are switched.

Referring to the shift register S2 again, since the first three-phase inverter 10 is driven by the clock signal /CK1, the first three-phase inverter 10 outputs a low signal to the inverter 20 and supplies a high signal to the AND gates L1 and L2 and to the first three-phase inverter 10 of the shift register S3. Here, since the clock signals CK1 and CK2 are low, the second three-state inverter 30 of the shift register S2 and the first three-state inverter 10 of the shift register S3 do not change phases.

As a result, as the clock signals CK1, CK2, /CK1 and /CK2 are switched, the AND gate L1 generates a high signal to supply to a first gate line G1. Here, when the clock signals are switched again, the AND gate L2 generates a high signal, and at this time, since there is no longer a high STV signal provided to the first three-phase inverter 10, the shift register S1 does not generate outputs.

Therefore, when the clock signals CK1, CK2, /CK1 and /CK2 continue to be switched, the AND gates sequentially output high signals.

Referring to FIG. 5, an operation of the gate driver of the TFT-LCD according to the first aspect of the present invention for the cinema mode will now be described.

For the cinema mode, the clock signal CK1 is identical to the clock signal /CK2, and the clock signal /CK1 to the clock signal CK2.

First, an operation of the gate driver 200 in section (1) of FIG. 5 will be described.

In section (1) of FIG. 5, the data driving start signal STV is supplied to the shift register S1, and the first and fourth shift clock signals CK1 and /CK2 are high and the second and third shift clock signals /CK1 and CK2 are low. At this time, since the first clock signal CK1 is high, the first three-phase inverter 10 generates a low signal to supply to the inverter 20.

The inverter 20 inverts the low signal and outputs a high signal through the output terminal GP1, and outputs a high signal to the second three-phase inverter 30, the AND gate L1, and the first three-phase inverter 10 of the shift register S2. Here, since the clock signal /CK1 is low, the second three-phase inverter 30 of the shift register S1 and the first three-phase inverter 10 of the shift register S2 do not change outputs. Therefore, the AND gate L1 receives a high signal output from the shift register S1 and a low signal output from the shift register S2 so as to output a low signal.

Next, an operation of the gate driver 200 in section (2) of FIG. 5 will be described.

The first and fourth shift clock signals CK1 and /CK2 are low and the second and third shift clock signals /CK1 and CK2 are high. At this time, the first three-phase inverter 10 of the shift register S1 does not change outputs, and thereby continues outputting a low signal, and the second three-state inverter 30 of the shift register S1 starts to drive and still receives the high value from the inverter 20 of the shift register S1 before the clock signal was switched, and outputs a low signal to the inverter 20, thereby, functioning as a logic latch. Hence, the output terminal GP1 continues to output high signals.

Here, the high signals from the inverter 20 of the shift register S1 are provided to the first three-phase inverter 10 of the shift register S2 and the AND gate L1. At this time, since the first three-phase inverter 10 of the shift register S2 receive the clock signal /CK1, the first three-phase inverter 10 outputs a low signal to the inverter 20 of the shift register S2. Therefore, the output terminal GP2 outputs a high signal in the same manner as the output terminal GP1.

When a high signal is output through the output terminal GP2, the output of the inverter 20 of the shift register S2 is supplied to the first three-phase inverter 10 of the shift register S3. At this time, since the third clock signal CK2 is high, the first three-phase inverter 10 of the shift register S3 starts to drive and outputs a high signal to the output terminal GP3.

Therefore, since the output terminals GP1, GP2, and GP3 are simultaneously high, the AND gates L1 and L2 output high signals.

Next, an operation of the gate driver 200 in section (3) of FIG. 5 will be described.

The first and fourth shift clock signals CK1 and /CK2 are high and the second and third shift clock signals /CK1 and CK2 are low. At this time, since the second three-phase inverter 30 of the shift register S1 does not receive a high input, there is no output from the output terminal GP1, and the first three-phase inverter 10 of the shift register S2 is not driven. However, since the second three-phase inverter 30 of the shift register S2 receives an output of the inverter 20 and outputs to the inverter 20, the output terminal GP2 continues to output a high signal.

In the shift register S3, the first three-phase inverter 10 does not change outputs and the second three-phase inverter 30 changes phases and receives the output of the inverter 20 and outputs again to the inverter 20. Therefore, the output terminal GP3 continues to output a high signal.

In the shift register S4, since the first three-phase inverter 10 is driven and the second three-phase inverter 30 does not change outputs, a low signal is supplied to the inverter 20. Therefore, the output terminal GP4 outputs a high signal.

In the shift register S5, the first three-phase inverter 10 does not change outputs and the second three-phase inverter 30 is driven. However, since there is no signal output from the inverter 20 in shift register S5 during section (3), the output terminal GP5 outputs a low signal.

Therefore, the AND gate L2 receives the high signals of the output terminals GP2 and GP3 and outputs a high signal, and the AND gate L3 receives the high signals of the output terminals GP3 and GP4 and outputs a high signal, and the AND gate L4 receives the high signal of the output terminal GP4 and the low signal of the output terminal GP5 and outputs a low signal.

Next, an operation of the gate driver 200 during section (4) of FIG. 5 will be described.

The first and fourth shift clock signals CK1 and /CK2 are low and the second and third shift clock signals /CK1 and CK2 are high. In the shift register S2, the first three-phase inverter 10 changes outputs, however there is no input signal provided, and the second three-phase inverter 30 does not change outputs. Therefore, a low signal is output through the output terminal GP2 of the shift register S2.

In the shift register S3, the first three-phase inverter 10 changes outputs, however, there is no input signal provided, and the second three-phase inverter 30 does not change outputs. Therefore, a low signal is output through the output terminal GP3 of the shift register S3.

In the shift register S4, the first three-phase inverter 10 does not change outputs, and the second three-phase inverter 30 is driven so as to receive a high signal output from the inverter 20 of the shift register S4 and to output a low signal to the inverter 20. Therefore, a high signal is output through the output terminal GP4 of the register S4.

In the shift register S5, the first three-phase inverter 10 changes phases to output a low signal to the inverter 20, and the second three-phase inverter 30 does not change outputs. Therefore, a high signal is output through the output terminal GP5 of the register S5.

In the shift register S6, the first three-phase inverter 10 does not change outputs, and the second three-phase inverter 30 does change outputs. Here, the inverter 20 of the shift register S6 does not generate a signal during section (4) of FIG. 5 so that there is no output, and thereby, the second three-phase inverter 30 does not receive an input signal. Therefore, a low signal is output through the output terminal GP6 of the shift register S6.

Therefore, as is clearly illustrated in section (4) of FIG. 5, in response to the low signals from the output terminals GP2 and GP3, the AND gate L2 outputs a low signal. The AND gate L3 receives the low signal from the output terminal GP3 and the high signal from the output terminal GP4 so as to output a low signal. The AND gate L4 receives the high signals from the output terminals GP4 and GP5 so as to output a high signal. The AND gate L5 receives the high signal from the output terminal GP5 and the low signal from the output terminal GP6 so as to output a low signal.

As a result, only one shift output is generated from the AND gate L4 during section (4).

Next, an operation of the gate driver 200 during section (5) of FIG. 5 will be described.

Here, the first and fourth shift clock signals CK1 and /CK2 are high and the second and third shift clock signals /CK1 and CK2 are low.

In the shift register S4, the first three-phase inverter 10 changes output and the second three-phase inverter 30 does not change output. At this time, since there is no signal provided to the first three-phase inverter 10, a low signal is output through the output terminal GP4 of the shift register S4.

In the shift register S5, the first three-phase inverter 10 does not change outputs and the second three-phase inverter 30 is driven to receive a high signal from the inverter 20 and to output a low signal to the inverter 20. Therefore, a high signal is output through the output terminal GP5 of the shift register S5.

In the shift register S6, the first three-phase inverter 10 changes outputs and the second three-phase inverter 30 does not change outputs. At this time, since a high signal from the shift register S5 is provided to the first three-phase inverter 10, a high signal is output through the output terminal GP6.

In the shift register S7, the first three-phase inverter 10 does not change outputs and the second three-phase inverter 30 changes outputs. At this time, since the inverter 20 of the shift register S7 does not generate a high signal, a low signal is provided through the output terminal GP7.

The operations of the gate driver 200 according to the first aspect of the present invention is described above. Accordingly, operation of the gate driver according to the first aspect of the present invention following section (5) of FIG. 5 can fully be understood without further description.

Figure 7:
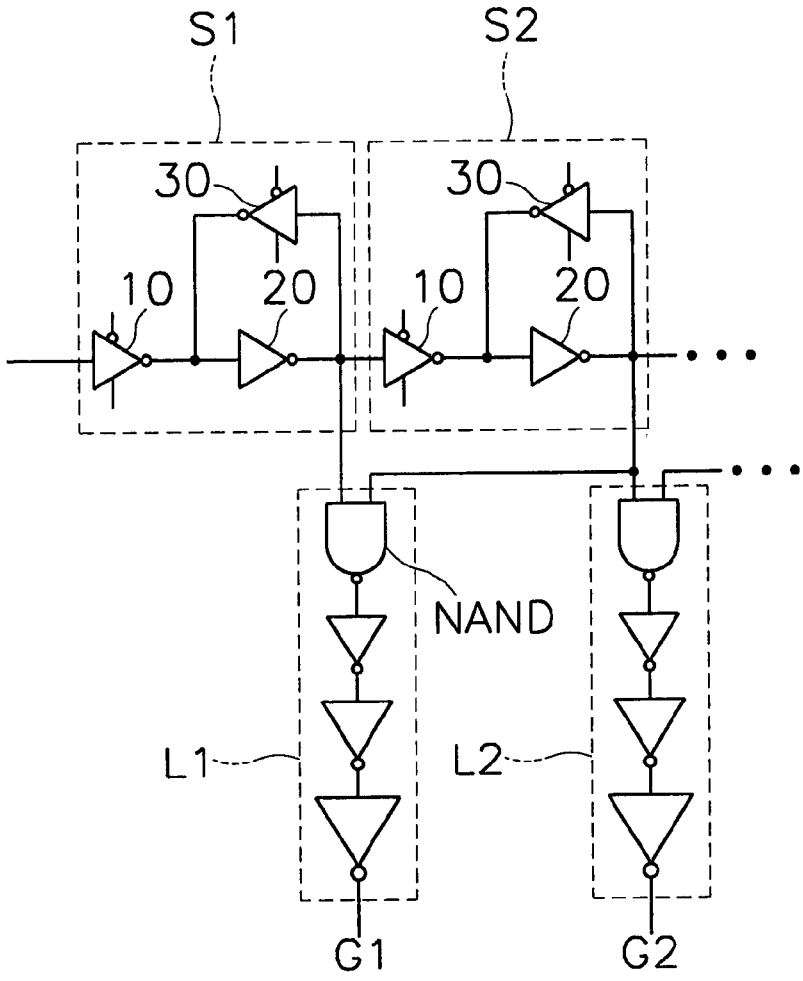
FIG. 7 is a logic diagram of a second preferred embodiment to implement the gate driver of the TFT-LCD according to the first aspect of the present invention.

Referring to FIG. 7, a second preferred embodiment according to the first aspect of the present invention, which is embodied within FIG. 3, will be described.

FIG. 7 shows a logic diagram of a second preferred embodiment for implementing the gate driver of the TFT-LCD according to the first aspect of the present invention. The gate driver of the TFT-LCD according to the second preferred embodiment for achieving the first aspect of the present invention is identical to the first preferred embodiment for achieving the first aspect of the present invention in the connection of the shift blocks, the connection of the shift registers including the shift blocks, and the connection of the logic arithmetic blocks of the logic arithmetic unit 220. However, the configuration of the logic arithmetic unit 220 is different.

Hence, the second preferred embodiment for achieving the first aspect of the present invention will be described by referring to FIG. 7, which is a simplified drawing of the shift registers and the logic arithmetic blocks.

In more detail, the logic arithmetic block including the logic arithmetic unit 220 comprises a NAND gate for performing logical NAND operations and three inverters.

Therefore, the operation of the shift register is identical to the first preferred embodiment for achieving the first aspect of the present invention. The difference is that the logic arithmetic block inverts high input signals twice so as to output a high signal. However, in the second preferred embodiment for achieving the first aspect of the present invention, signals identical to the first preferred embodiment are supplied to the gate lines in the same order as that of the first preferred embodiment.

In the above, it is found that the TFT-LCD according to the first aspect of the present invention has a multisync function. At this time, the multisync function depends on the variations of the display modes. That is, different images are displayed on the LCD screen by using identical R, G, and B data signals and gate driving signals.

Presented below is a TFT-LCD according to a second aspect of the present invention.

The TFT-LCD according to the second aspect of the present invention includes a configuration identical to that according to the first aspect of the present invention as shown in FIG. 2. However, the TFT-LCD according to the second aspect of the present invention has a different number of driving clock signals that are output from the timing controller to the data driver, and inner configurations of the data drivers are different. In other words, the timing controller 400, according to the first aspect of the present invention, outputs one driving clock signal to the data driver 300. However, the timing controller according to the second aspect of the present invention outputs four driving clock signals (referred to as "shift clocks" hereinafter) to the data driver 310. The data driver is driven by the four shift clocks output from the timing controller so as to have the same configuration as the gate driver 200 according to the first aspect of the present invention for performing the multisync function.

In the TFT-LCD according to the second aspect of the present invention having the above-mentioned configuration, the input LCD driving frequency must drive all the LCD pixels.

Referring to FIGS. 8 through 11, the TFT-LCD according to the second aspect of the present invention will be described.

Figure 8:
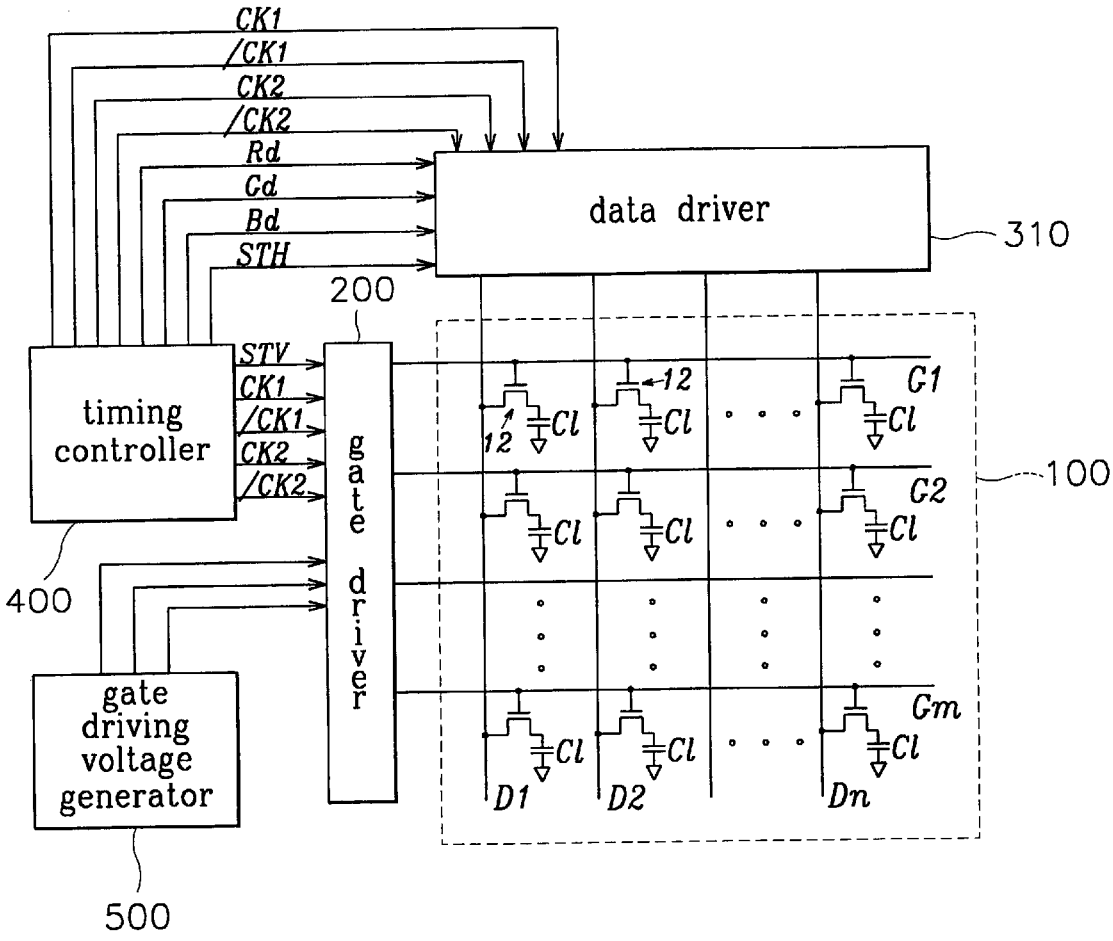
FIG. 8 is a block diagram of the TFT-LCD according to a second aspect of the present invention.

FIG. 8 shows a block diagram of the TFT-LCD according to the second aspect of the present invention. As shown, the TFT-LCD comprises an LCD panel 100, a gate driver 200, a data driver 310, a timing controller 410 and a gate driving voltage generator 500.

Here, since the LCD panel 100, gate driver 200 and the gate driving voltage generator 500 of the TFT-LCD according to the second aspect of the present invention as shown in FIG. 8 has the configuration and operation identical to those of the TFT-LCD according to the first aspect of the present invention, identical reference numerals are given to them.

In the above, the LCD panel 100 is an XGA type. In other words, there are 768 gate lines G1 through G768 and 3072 data lines D1 through D1024×3 on the LCD panel 100. Data lines are crossing and insulated from the gate lines. A plurality of TFTs 12 are formed on the area surrounded by the gate lines and the data lines. Here, the number of the gate lines is more than 768. However, since 768 gate lines are used for displaying visible images, the number of the gate lines is assumed as 768. Likewise, the number of the data lines is assumed as 1024×3 (R, G, and B).

The timing controller 410 determines the normal mode and the multisync mode according to the inputted LCD pixel driving frequencies. It is set to the normal mode, when a driving frequency corresponding to the XGA level is provided, and is set to the multisync mode when the driving frequency is below the XGA level.

Other than that the timing controller 410 includes four clock signal output terminals connected to the data driver 310, the timing controller 410 has the same configuration and performs the same operation as that of the timing controller 400 according to the first aspect of the present invention so as to perform the multisync function. The timing controller 410 outputs first through fourth clock signals CK1, /CK1, CK2 and /CK2, and gate driving start signal STV to the gate driver 200. It outputs R, G, and B data signals Rd, Gd, and Bd, and the data driving start signal STH to the data driver 310. It also generates for the data driver 310 a first shift clock CK10 that controls the operation of the data driver 310, a second shift clock /CK10 that is an inverted clock signal of the first shift clock CK10, a third shift clock CK20, and a fourth shift clock /CK20 that is an inverted clock signal of the third shift clock CK20. Therefore, the timing controller 410 in the normal mode makes the first clock signal CK1 identical to the third clock signal CK2, the second clock signal /CK1 to the fourth clock signal /CK2, the first shift clock CK10 to the third shift clock CK20, and the second shift clock /CK10 with the fourth shift clock /CK20 and outputs each clock signal to the gate driver 200 and the data driver 310. Also, the timing controller 410 in the multisync mode makes the first clock signal CK1 identical to the fourth clock signal /CK2, the second clock signal /CK1 to the third clock signal CK2, the first shift clock CK10 to the fourth shift clock /CK20, and the second shift clock /CK10 to the third shift clock CK20. And it outputs each clock signal to the gate driver 200 and the data driver 310.

The gate driver 200 in the normal mode generates one gate driving signal for each driving clock signal inputted from the timing controller 410 and supplies the signal to the gate lines. The gate driver 200 in the multisync mode also drives all the gate lines with clock signals, with two gate lines being driven at the same time by a driving clock signal within a period of a predetermined cycle. Here, a few of the gate lines may not be driven due to design restrictions of the gate driver, but should be designed not to affect the images displayed on the screen.

On the other hand, the data driver 310 in the normal mode sequentially shifts and stores the R, G, and B data signals corresponding to the shift clocks inputted from the timing controller 410, and concurrently supplies the signals to the data lines by the data driving start signals STH. The data driver 310 in the multisync mode supplies identical color data to two data lines for one clock signal from the shift clocks inputted from the timing controller 410 within a period of a predetermined cycle, and stores the data, and supplies the data to the data lines according to the data driving start signal STH. Here, a few gate lines may not be driven by the data driver 310 due to design restrictions, but should be designed not to affect the images displayed on the screen.

The operations of the above timing controller 410 in combination with gate driver 200 and data driver 310 achieve the multisync function according to the second aspect of the present invention.

Here, the period of the gate driver 200 and the data driver 310 is determined by the number of the blocks, and the number of the memory elements forming the blocks.

For example, when the period is set as two clock signals, the gate driver 200 has a plurality of blocks. And each block comprises four shift registers so that a gate driving signal is generated through four shift registers during three gate driving clocks. It is because each shift register is driven by receiving mutually inverted clock signals. Two clock signals out of four clock signals are identical and the other two clock signals are an inverted form of the previous two clock signals. The shift register operates according to the clock signals: whether they are high or low.

Therefore, two of the four gate driving signals generated in the four shift registers are generated concurrently during a half period of one clock signal. Hence, the gate driver 200 outputs 768 (=192×4) number of gate driving signals so as to perform the multisync function. At this time, since the number of the input clock signals necessary for the one hundred and ninety two (192) individual blocks is 384 (=2×192), 600 gate driving clock signals are not all used. Therefore, in a multisync mode, the timing controller 410 needs to properly adjust the timing of outputting the gate driving start signal (STV) to the gate driver 200 so that the number of the available clock signals out of the 600 gate driving clock signals is preferably 384.

The data driver 310 comprises 256 blocks, and each block comprises four shift registers so that while two shift clocks are generated, four shift signals are preferably generated through the four shift registers during two shift clocks. Here, two out of the four shift signals are concurrently generated. Therefore, the data driver 310 outputs 1024 (=256×4) number of shift signals so as to perform the multisync function. Here, three color signal data corresponding to one shift signal are concurrently supplied to the data driver 310, and each color signal is supplied to one data line, and accordingly, total data lines become 3072 (=3×1024). At this time, the number of the input clocks required for the two hundred and fifty six (256) blocks is 512 (=2×256), which does not use up all the 800 shift clocks. Hence, in the multisync mode, the timing controller 410 properly adjusts the timing of outputting the data driving start signal STH to the data driver 310 so that the number of the available clock signals out of the 800 data shift clocks is preferably 512.

Figure 9:
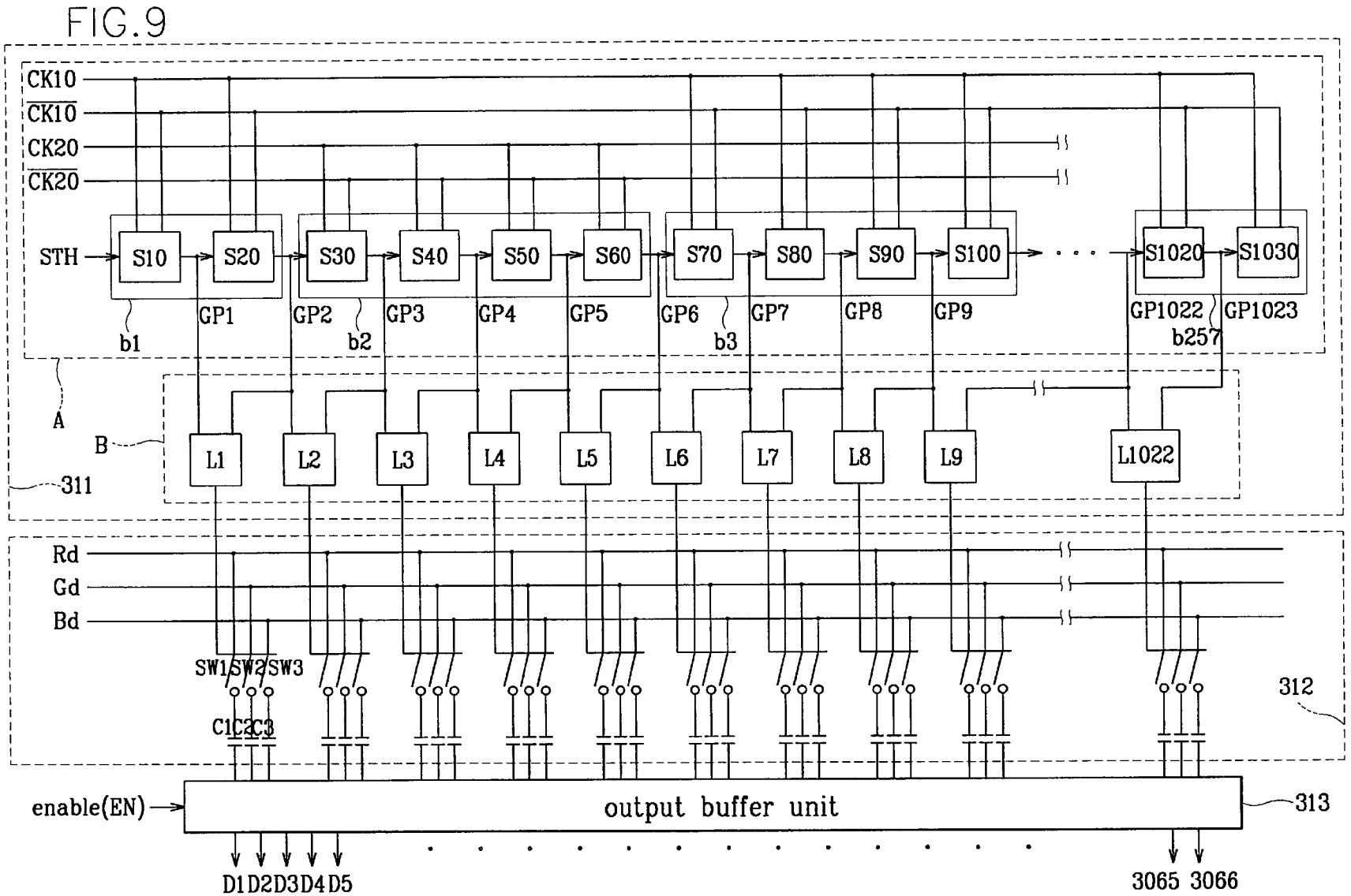
FIG. 9 is a block diagram of a data driver of the TFT-LCD according to the second aspect of the present invention.

Referring to FIG. 9, the configuration and detailed operation of the data driver 310 for performing the above operation will be described hereinafter.

The gate driver according to the second aspect of the present invention will not be described, because it is similar to what is described above.

FIG. 9 shows a block diagram of the data driver according to the first preferred embodiment for achieving the second aspect of the present invention. The data driver 310 shown in FIG. 9 receives shift clocks corresponding to SVGA signals for driving 800 data lines, and performs the multisync function to drive 3072 data lines. The data driver 310 has a shift unit 311, a latch unit 312, and an output buffer unit 313.

The shift unit 311 comprises a shift block unit A and a logic arithmetic unit B. The shift block unit A includes 257 shift blocks b1 through b257 that receive two of the four shift clocks CK10, /CK10, CK20, and /CK20 outputted from the timing controller 410. The logic arithmetic unit B receives a plurality of outputs from the shift blocks and performs logic arithmetic operations.

Each shift block b1 through b257 of the shift block unit A is connected in series. The first shift block b1 (S10 and S20) and the last shift block (S1020 and S1030) b257 respectively comprise two shift registers connected in series. Other shift blocks comprise four shift registers connected in series.

The odd shift blocks b1, b3, . . . , b257 receive the clocks CK10 and /CK10, and the even shift blocks b2, b4, . . . , b256 receive the clocks CK20 and /CK20. In detail, each shift register of the odd shift blocks b1, b3, . . . , b257 receives the shift clocks CK10 and /CK10, and each shift register of the even shift blocks b2, b4, . . . , b256 receives the shift clocks CK20 and /CK20, and each shift register includes one output terminal GP1, GP2, . . . , or GP1023.

The logic arithmetic unit B includes 1022 logic arithmetic blocks L1, L2, . . . , L1022, and two input terminals of each logic arithmetic blocks L1, L2, . . . , L1022 are connected to an output terminal of a shift register and to an input terminal of the neighboring shift register.

The latch unit 312 includes three switches SW1, SW2, and SW3 driven by each output of the logic arithmetic blocks L1, L2, . . . , L1022, and a terminal of each switch SW1, SW2, and SW3 is respectively connected to one of three capacitors C1, C2, and C3. Therefore, the latch unit 312 comprises 3×1022 switches and 3×1022 capacitors. Then, the R data signal Rd is supplied to the other terminal of the switch SW1, and the G data signal Gd is supplied to the other terminal of the switch SW2, the B data signal Bd is supplied to other terminal of the switch SW3. At this time, the R, G, and B data signals Rd, Gd and Bd may be analog or digital signals. If the data signals are digital, an A/D converter for converting the digital color signals to analog signals must be further added.

The output buffer unit 313 receives the outputs of each capacitor C1, C2, and C3 and includes a number of output terminals that is equal to the number of the data lines. Therefore, in this case, the output buffer unit 313 has 3066 output terminals.

Figure 10:
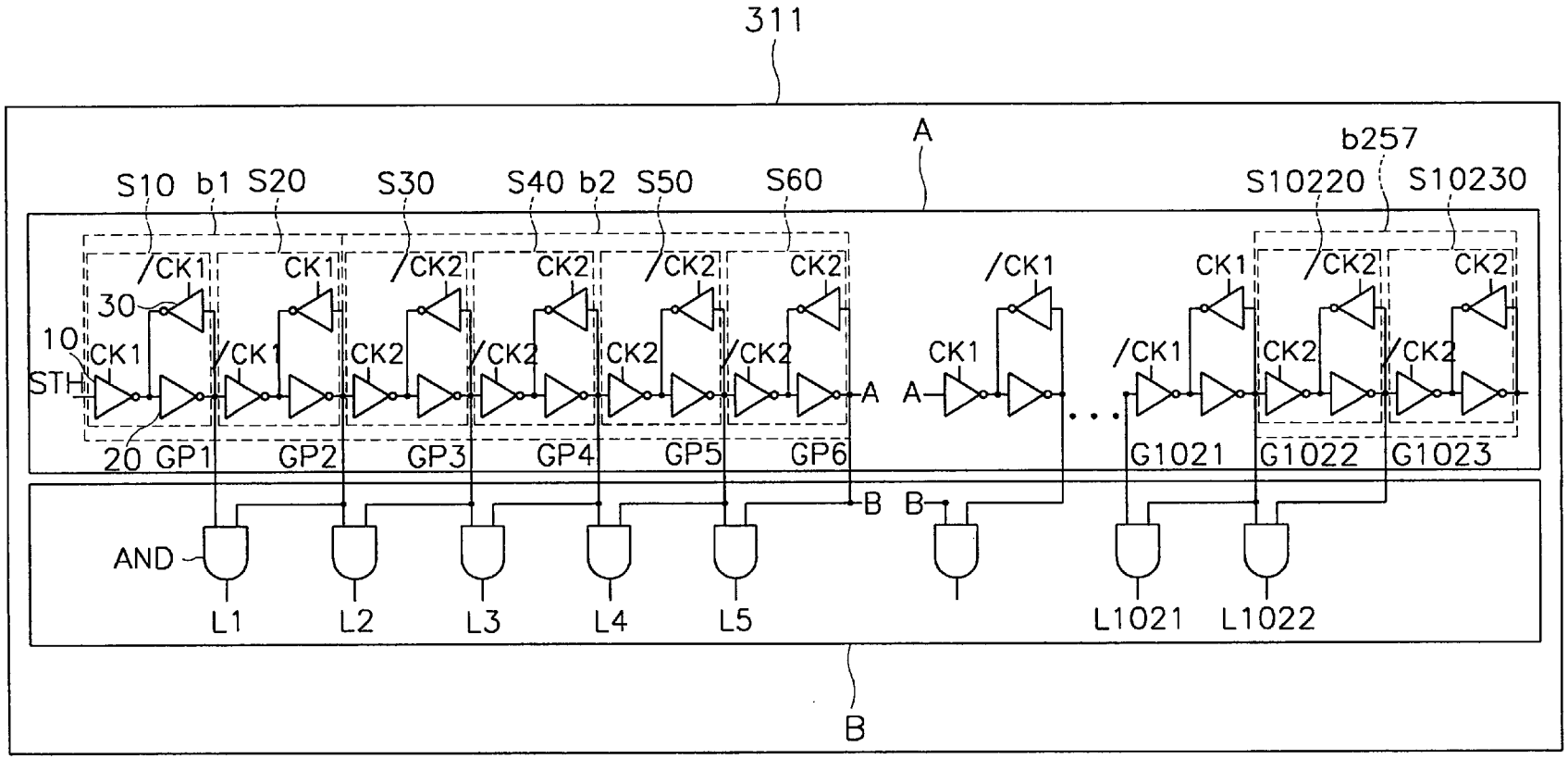
FIG. 10 is a logic diagram of the first preferred embodiment to implement a shift unit of the TFT-LCD according to the second aspect of the present invention.
Figure 11:
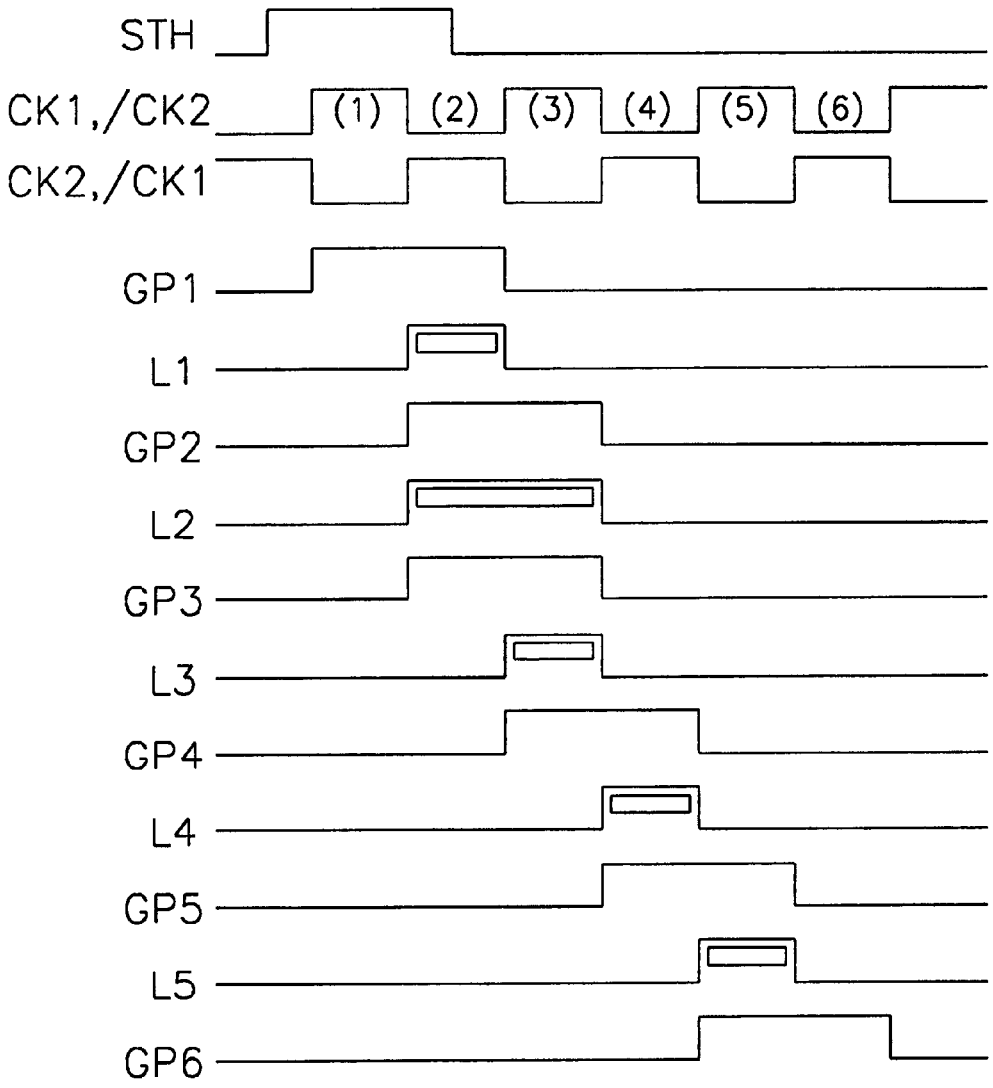
FIG. 11 is a timing diagram for the first to fourth shift clock signals supplied to the shift unit in order for the TFT-LCD according to the second aspect of the present invention to perform the multisync function.

Referring to FIGS. 10 and 11, an operation of the data driver 310 according to the second aspect of the present invention will now be described.

The timing controller 410 outputs shift clocks in the normal mode, and when the data driving start signal STH is supplied, the shift register S10 initially drives during a period of a first clock signal that is an initially input shift clock signal so as to output a high signal through the output terminal GP1. Then, the shift register S20 drives during a period from a half period of the first clock signal to a half period of a second clock signal (i.e., one period) so as to receive the high output of the shift register S10 and to output high signals. The shift register S30 drives during a period from a half period of the second clock signal to a half period of a third clock signal (i.e., one period) so as to output a high signal according to high signals of the shift register S20 The other shift registers operate in a similar manner.

The first logic block L1 of the logic arithmetic unit B receives high signals of the shift registers S10 and S20 so as to output high signals, and the logic block L2 then outputs high signals, and the logic blocks L3 through L1022 are sequentially driven to produce high output signals.

The switches SW1, SW2, and SW3 connected to the logic block L1 are turned on to charge the R, G, and B data signals Rd, Gd, and Bd to the capacitors C1, C2, and C3. The switches SW1, SW2, and SW3 connected to the logic block L2 are turned on to charge the R, G, and B data signals Rd, Gd, and Bd to the capacitors C1, C2, and C3. Accordingly, the other switches connected to the other logic blocks L3 through L1022 are turned on as the logic blocks L3 through L1022 sequentially output high signals so as to charge the R, G, and B data signals Rd, Gd, and Bd to the associated capacitors C1, C2, and C3.

The output buffer unit 313 maintains the R, G, and B data signal charged to the capacitors, and when an enable signal EN is input, the output buffer unit 313 concurrently supplies the R, G, and B data signals Rd, Gd, and Bd to the data line. At this time, the time for the enable signal EN to be supplied to the output buffer unit 313 is after the high signal from the last logic block L1022, and thereby the R, G, and B data signals Rd, Gd, and Bd are all charged to the last capacitor.

At this time, the gate driver 200 according to the second aspect of the present invention supplies the gate driving signals corresponding to the input gate driving clocks.

Since the above-noted operation of the data driver 310 in the normal mode can be inferred from the description of the gate driver according to the first aspect of the present invention as shown in FIGS. 3 and 4, a detailed description will not be provided.

On the other hand, the data driver 310 according to the second aspect of the present invention receives the shift clocks in the multisync mode from the timing controller 410. Then, the shift register S10 outputs high signals through the output terminal GP1 during one period of the first shift clock signal. The shift register S20 receives the high outputs of the shift registers S10 and outputs high signals through the output terminal GP2 during one period from the half period of the first clock signal to the half period of the second clock signal.

However, the shift register S30 drives during the period from the half period of the first clock signal to the half period of the second clock signal and outputs high signals during the same period as the shift register S20.

Hence, two shift signals are output during the half period of the shift clock.

On the other hand, the shift register S40 receives the high signals of the shift register S30 and outputs high signals during the period from the half period of the second clock signal to the half period of the third clock signal, and the shift register S50 outputs high signals during the period from the half period of the third clock signal to the half period of the fourth clock signal.

As a result, the shift block b2 generates four shift signals during the two periods from the half period of the second clock signal to the half period of the fourth clock signal. From the view of the whole shift block (excluding the first and last shift blocks), the first and the second shift registers in each shift block L2 through L1022 are concurrently driven to generate high signals.

The first logic block L1 of the logic arithmetic unit B receives the high signals of the shift registers S10 and S20 so as to output high signals, and the logic block L2 outputs high signals during a next half period after the logic block L1 generated high signals, and the logic block L3 also drives concurrently with the logic block L2 so as to output high signals. The logic block L4 generates high signals during a half period of a next clock signal after the logic block L3 is driven for a half period.

Hence, the outputs of the logic arithmetic unit B generate four signals during the period of two clocks from the point of view of each shift block.

The switches SW1, SW2, and SW3 connected to the logic block L1 are turned on so as to charge the R, G, and B data signals Rd, Gd, and Bd to the capacitors C1, C2, and C3. Then, the switches SW1, SW2, and SW3 respectively connected to the logic blocks L2 and L3 are turned on so as to charge the R, G, and B data signals Rd, Gd, and Bd to the capacitors C1, C2, and C3. Therefore, identical R, G, and B data signals overlap the six data lines.

The output buffer unit 313 maintains the R, G, and B data signals Rd, Gd, and Bd charged in each capacitor, and when the enable signal En is provided, the output buffer unit 313 concurrently supplies the R, G, and B data signals to the data lines. At this time, the time for the enable signal EN to be supplied to the output buffer unit 313 is after the last logic block L1022 receives a high signal and thereby the R, G, and B data signals Rd, Gd, and Bd are all charged to the last capacitor.

Hence, the TFT-LCD according to the second aspect of the present invention can drive all the LCD pixels of the XGA grade using the SVGA driving frequency by the multisync functions of the data driver 310 and the gate driver 200.

Referring to FIGS. 10 and 11, a preferred embodiment for implementing the data driver 311 of the TFT-LCD according to the second aspect of the present invention will now be described.

FIG. 10 shows a logic diagram for implementing the shift unit 311 of the TFT-LCD according to the second aspect of the present invention.

As shown, the shift unit 311 comprises a shift block unit A and a logic arithmetic unit B.

The shift block unit A includes 256 blocks, each of which include four shift registers. However, the blocks b1 and b257, positioned first and last, include only two shift registers.

Here, each shift register comprises a first three-phase inverter 10 that receives the data driving start signal STH, an inverter that receives outputs of the first three-phase inverter 10, and a second three-phase inverter 30 that receives outputs of the inverter 20, and an output terminal is connected to an input terminal of the inverter 20.

At this time, the three-phase inverters 10 and 30 have different driving clock signals. In the odd shift blocks, the first three-phase inverter 10 uses the clock signal CK1 as the driving clock signal, and the second three-phase inverter 30 uses the clock signal /CK1 as the driving clock signal. In the even shift blocks, the first three-phase inverter 10 uses the clock signal CK2 as the driving clock signal, and the second three-phase inverter 30 uses the clock signal /CK2 as the driving clock signal.

Each shift register b1 through b257 has an output terminal connected to the logic arithmetic blocks L1 through L1022. Here, each logic arithmetic block is defined as an AND gate for performing a logical AND operation on the two inputs. That is, the AND gate receives the outputs of the shift register and the neighboring shift register.

Referring to FIG. 11, a multisync operation of the shift unit 311 will now be described.

FIG. 11 shows a timing diagram of the first through the fourth shift clocks provided to the shift unit for achieving the multisync function by the TFT-LCD according to the second aspect of the present invention. As shown, the first shift clock signal CK1 is identical to the fourth shift clock signal /CK2, and the second shift clock signal /CK1 is identical to the third shift clock signal CK2.

An operation of the shift unit 311 in section (1) of FIG. 11 will now be described.

The data driving start signal STH is supplied to the shift register S10 in section (1) of FIG. 11. The first and fourth shift clocks CK1 and /CK2 are high, and the second and third shift clocks /CK1 and CK2 are low. At this time, the first three-phase inverter 10 generates a low signal to be supplied to the inverter 20 as the first shift clock signal CK1 is high.

The inverter 20 inverts the low signal to the high signal to be output through the output terminal GP1, and the inverter 20 outputs the high signal to the second three-phase inverter 30, the AND gate, and the first three-phase inverter 10 of the shift register S20. Here, since the clock signal /CK1 is low, the second three-phase inverter 30 of the shift register S10 and the first three-phase inverter 10 of the shift register S20 do not switch outputs. Therefore, the AND gate L1 receives the high signal output from the shift register S10 and the low signal output from the shift register S20, and outputs a low signal.

Next, an operation of the shift unit 311 in section (2) of FIG. 11 will be described.

The first and fourth shift clocks CK1 and /CK2 are low, and the second and third shift clocks /CK1 and CK2 are high. At this time, the first three-phase inverter 10 of the shift register S10 does not switch outputs and outputs a low signal, and the second three-phase inverter 30 of the shift register S10 and the first three-phase inverter 10 of the shift register S20 receives the high output from the inverter 20 of the shift register S10 before the clocks are changed so as to output a low signal to the inverter 20, working as a latch. Therefore, the output terminal GP1 continues to output high signals.

Here, the high signal from the inverter 20 of the shift register S10 are supplied to the first three-phase inverter 10 of the shift register S20 and the AND gate L1. At this time, since the clock signal /CK1 allows the first three-phase inverter 10 of the shift register S20 to switch output, the first three-phase inverter 10 outputs a low signal to the inverter 20 of the shift register S20. Therefore, the output terminal GP2 outputs a high signal like the output terminal GP1.

When a high signal is output from the output terminal GP2, the output of the inverter 20 of the shift register S20 is provided to the first three-phase inverter 10 of the shift register S30. At this time, since the third clock signal CK2 is high, the first three-phase inverter 10 of the shift register S30 drives a high signal output to the output terminal GP3.

Therefore, since the output terminals GP1, GP2, and GP3 are simultaneously high, the AND gates L1 and L2 output high signals.

Next, an operation of the shift unit 311 in section (3) of FIG. 11 will now be described.

The first and fourth shift clock signals CK1 and /CK2 are high, and the second and third shift clock signals /CK1 and CK2 are low. At this time, since the second three-phase inverter 30 of the shift register S10 does not switch outputs, there is a low output from the output terminal GP1, and the first three-phase inverter 10 of the shift register S20 does not change output. However, since the second three-phase inverter 30 of the shift register S20 receives the output from the inverter 20 and outputs again to the inverter 20, the output terminal GP2 continues to output a high signal.

The first three-phase inverter 10 of the shift register S30 does not change output, but the second three-phase inverter 30 receives the output from the inverter 20 and outputs a low signal to the inverter 20. Therefore, the output terminal GP3 continues to output a high signal.

Since the first three-phase inverter 10 of the shift register S40 changes output and the second three-phase inverter 30 does not, a low signal is provided to the inverter 20. Hence, the output terminal GP4 outputs a high signal.

During the period of section (3) in FIG. 11, the first three-phase inverter 10 of the shift register S50 is not driven, but the second three-phase inverter 30 is driven. However, since there is no output signal from the inverter 20 during section (3) of FIG. 11, the output terminal GP5 outputs a low signal.

Therefore, the AND gate L2 receives high signals of the output terminals GP2 and GP3 and outputs high signals. The AND gate L3 receives high signals of the output terminals GP3 and GP4 and outputs high signals. The AND gate L4 receives a high signal of the output terminal GP4 and a low signal of the output terminal GP5 so as to output a low signal.

As a result, the high signals of the AND gates L2 and L3 turn on the six switches connected to the AND gates L2 and L3 as shown in FIG. 9 so as to charge the R, G, and B data signals Rd, Gd, and Bd to each associated capacitor.

The high signals of the AND gates L1 and L2 outputted during section (2) of FIG. 11 charge the identical R, G, and B data signals Rd, Gd, and Bd to each capacitor through six switches. However, the high signals outputted by the AND gate L2 during section (3) of FIG. 11 change these data by storing the R, G, and B data signals in the capacitors.

Next, an operation of the shift unit 311 during section (4) of FIG. 11 will now be described.

The first and fourth shift clocks CK1 and /CK2 are low and the second and third shift clocks /CK1 and CK2 are high. The first three-phase inverter 10 of the shift register S20 receives a high clock signal but as there is no input signal to it, it outputs a high signal and the second inverter 20 does not output a high signal. Therefore, a low signal is output from the output terminal GP2 of the shift register S20.

The first three-phase inverter 10 of the shift register S30 receives a high clock signal, but as there is no input signal, the second inverter 20 does not output a high signal and the second three-phase inverter 30 does not change phase. Therefore, a low signal is output through the output terminal GP3 of the shift register S30.

The first three-phase inverter 10 of the shift register S40 does not receive a high clock signal and does not change phases, and the second three-phase inverter 30 receives high signals from the inverter 20 of the shift register S40 and continues to output a low signal to the inverter 20. Therefore, a high signal continues to be output from the output terminal GP4 of the shift register S40.

The first three-phase inverter of the shift register S50 receives a high clock signal and its output to the inverter 20 changes to a low signal. The second three-phase inverter 30 does not change phases. Therefore, the output terminal GP5 of the shift register S50 outputs a high signal.

The first three-phase inverter 10 of the shift register S60 does not receive a high clock signal and the second three-phase inverter 30 receives a high clock signal. Therefore, the inverter 20 of the shift register S60 does not output a high signal since the inverter 20 did not generate a high signal in the previous section (3), and thereby, the output terminal GP6 of the shift register S60 continues to output a low signal.

Therefore, during section (4) of FIG. 11, the AND gate L2 outputs a low signal according to the low signals of the output terminals GP2 and GP3, and the AND gate L3 receives the low signal of the output terminal GP3 and the high signal of the output terminal GP4 and then outputs a low signal. The AND gate L4 receives the high signals of the output terminals GP4 and GP5 and outputs a high signal. The AND gate L5 receives the high signal from the output terminal GP5 and the low signal from the output terminal GP6 and outputs a low signal.

As a result, one shift output value outputted from the AND gate L4 is generated during section (4) of FIG. 11.

Next, an operation of the shift unit 311 during section (5) of FIG. 11 will now be described.

During the period of section (5), the first and fourth shift clocks CK1 and /CK2 are high, and the second and third shift clocks /CK1 and CK2 are low.

The first three-phase inverter 10 of the shift register S40 changes to low and the second three-phase inverter 30 does not change phases. At this time, since the first three-phase inverter 10 receives no input signal, the output terminal GP4 of the shift register S40 outputs a low signal.

The first three-phase inverter 10 of the shift register S50 does not change phases. The second three-phase inverter 30 changes phases and receive the high signal from the inverter 20 and outputs again a low signal to the inverter 20. Therefore, the output terminal GP5 of the shift register S50 outputs a high signal.

During the period of section (5), the first three-phase inverter 10 of the shift register S60 changes phase and the second three-phase inverter 30 does not. At this time, since the first three-phase inverter 10 receives a high signal from the shift register S50 the output terminal GP6 outputs a high signal.

Rest of the shift registers of the shift unit 311 operate in the same manner.

Figure 12:
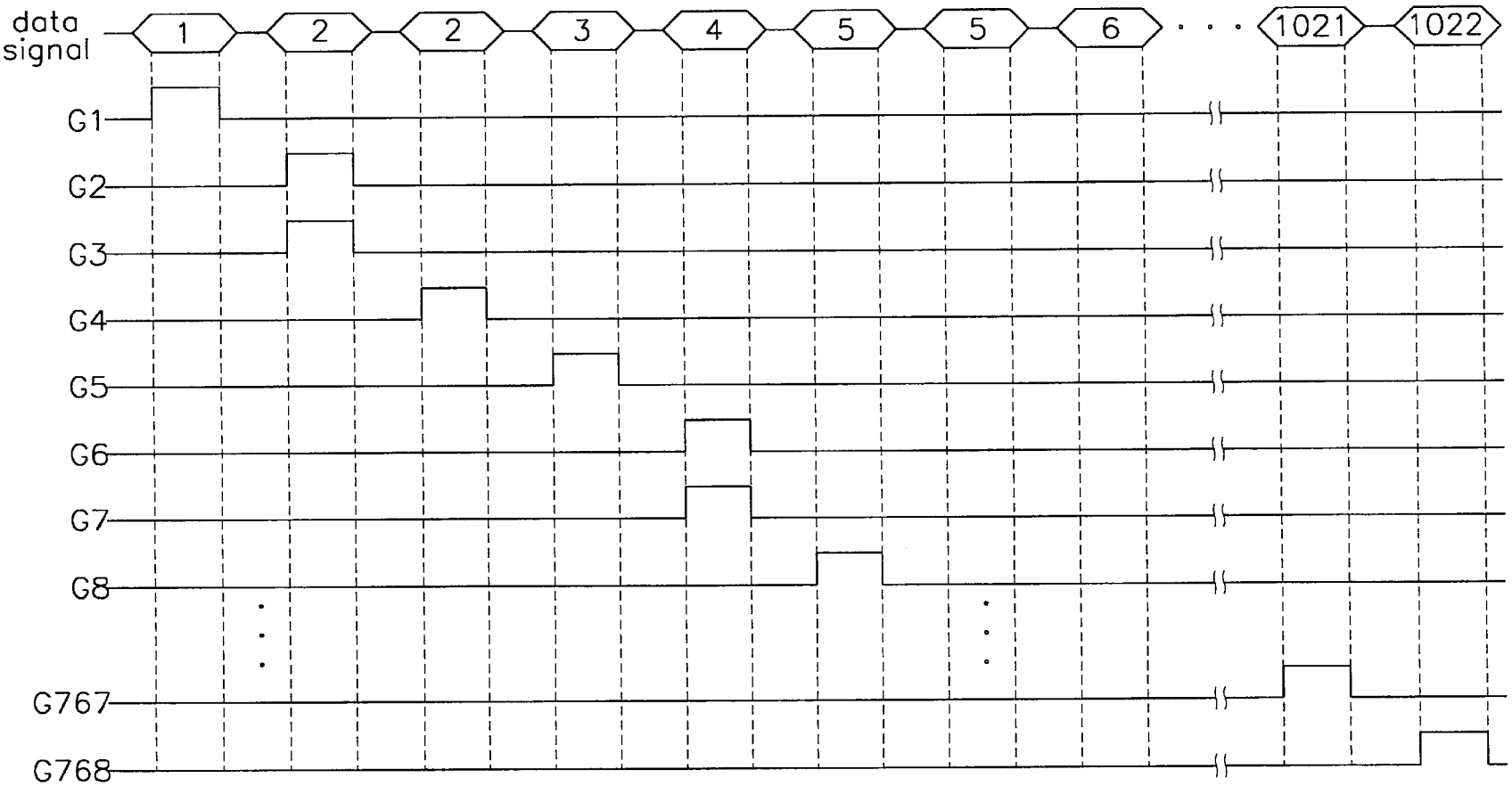
FIG. 12 is a timing diagram of the TFT-LCD according to the second aspect of the present invention performing the multisync function.

FIG. 12 shows a timing diagram for implementation of the multisync function of a TFT-LCD according to an embodiment of the second aspect of the present invention, which shows the outputs of the gate driver 200 and the data driver 310 shown in FIG. 8.

As shown in FIG. 12, the data driver 310 repeatedly outputs one data signal such as the data signals 2 and 5 by the multisync operation, and the gate driver 300 also repeatedly outputs one gate driving signal such as the gate lines G2 and G3, and G6 and G7 by the multisync operation. Therefore, the TFT-LCD according to the embodiment for implementing the second aspect of the present invention drives all the pixels of the XGA grade LCD panel although a SVGA grade driving signal is supplied.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display device, comprising:

a liquid crystal display panel including a gate line, a data line and a thin-film transistor with a gate electrode connected to the gate line and a source electrode connected to the data line;

a timing controller that outputs a first clock signal, a second clock signal that is an inversion of the first clock signal, a third clock signal, and a fourth clock signal that is an inversion of the third clock signal, wherein said timing controller changes outputting clock signals depending on an operation mode;

a data driver supplying per line a gray image voltage through the data lines; and a gate driver including a first block and a second block, wherein the first block has a number of serially connected latch blocks and receives the first clock signal and the second clock signal, and the second block has a number of serially connected latch blocks and receives the third clock signal and the fourth clock signal, and wherein, in a multisync mode, said gate driver concurrently outputs a plurality of gate driving signals to a plurality of gate lines for a period according to the number of latch blocks.

2. The device of claim 1, wherein the gate driver comprises:

a shift register having the first block and the second block connected alternately in series; and a logic arithmetic unit including a plurality of logic arithmetic blocks that receives outputs of an (n)th latch block and an (n+1)th latch block and performs a logic arithmetic operation, wherein output terminals of each logic arithmetic block is connected to a corresponding gate line.

3. The device of claim 2, wherein the shift register unit has a starting block and an ending block, each comprising two latch blocks, and other blocks, each comprising four latch blocks.

4. The device of claim 2, wherein the latch block is a shift register.

5. The device of claim 2, wherein the latch block comprises:

a first three-phase inverter that operates in response to the first clock signal or the third clock signal;

an inverter having an input terminal connected to an output terminal of the first three-phase inverter; and a second three-phase inverter having an input terminal connected to an output terminal of the inverter, and having an output terminal connected to the input terminal of the inverter, and that operates in response to the second clock signal or the fourth clock signal.

6. The device of claim 2, wherein the logic arithmetic block is an AND gate.

7. The device of claim 2, wherein the logic arithmetic block comprises:

an AND gate performing a logical AND operation on outputs of the (n)th latch block and the (n+1)th latch block;

a first inverter inverting an output of the logic AND gate; and a second inverter inverting an output of the first inverter.

8. The device of claim 1, wherein, at least during the multisync mode, the first positioned latch block or the second positioned latch block in the first block or the second block outputs the same signal as the last latch block of a previous block.

9. The device of claim 1, wherein, in a normal mode, the timing controller outputs the first clock signal that is the same as the third clock signal and the second clock signal that is the same as the fourth clock signal, and wherein, in a multisync mode, the timing controller outputs the first clock signal that is the same as the fourth clock signal and the second clock signal that is the same as the third clock signal.

10. A driving device for a liquid crystal display having a gate line, a data line, a plurality of matrix type pixels configured by the crossing of the gate lines and the data lines, and a thin-film transistor having a gate electrode connected to a gate line and a source electrode connected to a data line, comprising:

a data driver supplying a gray voltage per line through the data line; and a gate driver including a plurality of first blocks that have a number of serially connected latch blocks and receive a first clock signal and a second clock signal and a plurality of second blocks that have a number of serially connected latch blocks and receive third clock signal and a fourth clock signal, and wherein, in a multisync mode, said gate driver concurrently outputs a plurality of driving signals to a plurality of gate lines for a period based on the number of latch blocks, and wherein the first clock signal is an inversion of the second clock signal and the second clock signal is an inversion of the third clock signal.

11. The driving device of claim 10, wherein the gate driver further comprises:

a shift register unit having the first block and the second block connected alternately in series; and a plurality of logic arithmetic blocks receiving outputs of (n)th latch block and (n+1)th latch block and performing logic arithmetic operations, wherein each output terminal of the logic arithmetic block is connected to a corresponding gate line.

12. The driving device of claim 11, wherein the shift register unit has a starting block and an ending block, each comprising two latch blocks and has other blocks, each comprising four latch blocks.

13. The driving device of claim 11, wherein the latch block is a shift register.

14. The driving device of claim 11, wherein the latch block comprises:

a first three-phase inverter that operates in response to the first clock signal or the third clock signal;

an inverter having an input terminal connected to an output terminal of the first three-phase inverter; and a second three-phase inverter having an input terminal connected to an output terminal of the inverter and having an output terminal connected to the input terminal of the inverter, and that operates in response to the second clock signal or the fourth clock signal.

15. The driving device of claim 11, wherein the logic arithmetic block is an AND gate.

16. The driving device of claim 10, wherein, at least in a multisync mode, the first positioned latch block and the second positioned latch block in the first block or the second block output the same signal as the last latch block of a previous block.

17. The driving device of claim 10, further comprising a timing controller, wherein, in a normal mode, the timing controller outputs the first clock signal that is the same as the third clock signal and the second clock signal that is the same as the fourth clock signal, and wherein, in a multisync mode, the timing controller outputs the first clock signal that is the same as the fourth clock signal and the second clock signal that is the same as the third clock signal.

18. A scanning device for a display device having a plurality of scanning lines through which scanning signals are transferred, and a plurality of data lines through which image signals are transferred, comprising:

a timing controller that outputs a first clock signal, a second clock signal that is an inversion of the first clock signal, a third clock signal, and a fourth clock signal that is an inversion of the third clock signal, wherein said timing controller changes outputting clock signals depending on an operation mode;

a data driver supplying a gray image voltage per line through the data line; and a gate driver including a plurality of first blocks that have a number of serially connected latch blocks and receive the first clock signal and the second clock signal and a plurality of second blocks that have a number of serially connected latch blocks and receive the third clock signal and the fourth clock signal, wherein, in a multisync mode, said gate driver concurrently outputs a plurality of driving signals to a plurality of gate lines for a period based on the number of latch blocks.

19. The driving device of claim 18, wherein the gate driver comprises:

a shift register unit having the first block and the second block connected alternately in series; and a plurality of logic arithmetic blocks receiving outputs of an (n)th latch block and an (n+1)th latch block and performing a logic arithmetic operation, wherein each output terminal of the logical arithmetic block is connected to a corresponding gate line.

20. The driving device of claim 19, wherein the shift register unit has a starting block and an ending block, each comprising two blocks and has other blocks, each comprising four latch blocks.

21. The driving device of claim 19, wherein the logic arithmetic block is an AND gate.

22. The driving device of claim 18, wherein, at least in a multisync mode, the first positioned latch block and the second positioned latch block in the first block or the second block output the same signal as the last latch block of a previous block.

23. The driving device of claim 18, wherein the latch block is a shift register.

24. The driving device of claim 18, wherein the latch block comprises:

a first three-phase inverter that operates in response to the first clock signal or the third clock signal;

an inverter having an input terminal connected to an output terminal of the first three-phase inverter; and a second three-phase inverter having an input terminal connected to an output terminal of the inverter and having an output terminal connected to the input terminal of the inverter, and that operates in response to the second clock signal or the fourth clock signal.

25. The driving device of claim 18, wherein, in a normal mode, the timing controller outputs the first clock signal that is the same as the third clock signal and the second clock signal that is the same as the fourth clock signal, and wherein, in a multisync mode, the timing controller outputs the first clock signal that is the same as the fourth clock signal and the second clock signal that is the same as the third clock signal.

26. A liquid crystal display device, comprising:

a liquid crystal display panel including a gate line, a data line, and a thin-film transistor with a gate electrode connected to the gate line and a source electrode connected to the data line;

a timing controller that outputs a first clock signal, a second clock signal that is an inversion of the first clock signal, a third clock signal, a fourth clock signal that is an inversion of the third clock signal, a first shift clock signal, a second shift clock signal that is an inversion of the first shift clock signal, and a third shift clock signal, and a fourth shift clock signal that is an inversion of the third shift clock signal, wherein said timing controller changes outputting clock signals depending on an operation mode;

a data driver including a first shift block that has a number of serially connected latch blocks and receives the first shift clock signal and the second shift clock signal, and the second shift block that has a number of serially connected latch blocks and receives the third shift clock signal and the fourth shift clock signal, wherein said data driver outputs a plurality of shift signals for a period determined by the number of the shift blocks and concurrently supplies gray voltages to a plurality of data lines by the shift signals;

a gate driver including a first block that has a number of serially connected latch blocks and receives the first clock signal and the second clock signal, and a second block that has a number of serially connected latch blocks and receives the third clock signal and the fourth clock signal, wherein, in a multisync mode, said gate driver concurrently outputs a plurality of gate driving signals to a plurality of gate lines for a period according to the number of latch blocks.

27. The device of claim 26, wherein the gate driver further comprises:

a shift register unit having the first block and the second block connected alternately in series; and a logic arithmetic unit including a plurality of first logic arithmetic blocks that receives outputs of an (n)th latch block and an (n+1)th latch block and performs a logic arithmetic operation, wherein output terminals of each logic arithmetic block is connected to a corresponding gate line.

28. The device of claim 27, wherein the first logic arithmetic block is an AND gate that receives outputs of the (n)th shift register and the (n+1)th shift register and performs a logical AND operation.

29. The device of claim 26, wherein, at least during the multisync mode, the first positioned latch block or the second positioned latch block in the first block or the second block outputs the same signal as the last latch block of a previous block.

30. The device of claim 26, wherein the latch block is a shift register.

31. The device of claim 26, wherein the latch block comprises:

a first three-phase inverter that operates in response to the first clock signal or the third clock signal;

an inverter having an input terminal connected to an output terminal of the first three-phase inverter; and a second three-phase inverter having an input terminal connected to an output terminal of the inverter and having an output terminal connected to the input terminal of the inverter, and that operates in response to the second clock signal or the fourth clock signal.

32. The device of claim 26, wherein, in a normal mode, the timing controller outputs the first clock signal that is the same as the third clock signal and the second clock signal that is the same as the fourth clock signal, and wherein, in a multisync mode, the timing controller outputs the first clock signal that is the same as the fourth clock signal and the second clock signal that is the same as the third clock signal.

33. The device of claim 26, wherein the data driver further comprises:

a shift unit concurrently outputting a plurality of shift signals according to the first shift clock through the fourth shift clock in a multisync mode;

a data register unit receiving R, G, and B data signals, and sequentially shifting and storing the R, G, and B data signals according to outputs from the shift unit; and an output buffer unit supplying to data lines the R, G, and B data signals stored in the data register unit according to data driving start signals from the timing controller.

34. The device of claim 33, wherein the LCD device further comprises a digital/analog converter that converts the R, G, and B data signals to corresponding analog gray signals when the supplied R, G, and B data signals are digital.

35. The device of claim 33, wherein the shift unit comprises:

a shift block unit having the first shift block and the second shift block connected alternately in series; and a second logic arithmetic unit including a plurality of second logic arithmetic blocks each receiving outputs of an (n)th shift latch and an (n+1)th shift latch and performing a logic arithmetic operation.

36. The device of claim 35, wherein the shift block unit is a shift register.

37. The device of claim 35, wherein the shift block unit comprises:

a first three-phase inverter that operates in response to the first clock signal or the third clock signal;

an inverter having an input terminal connected to an output terminal of the first three-phase inverter; and a second three-phase inverter having an input terminal connected to an output terminal of the inverter and having an output terminal connected to the input terminal of the inverter, and that operates in response to the second clock signal or the fourth clock signal.

38. The device of claim 35, wherein the second logic arithmetic unit is an AND gate.

39. The device of claim 35, wherein the data register unit comprises:

a first switch, a second switch and a third switch, wherein the terminal of each switch is connected to an output terminal of the second logic arithmetic block; and a first capacitor, a second capacitor and a third capacitor, wherein the terminal of each capacitor is connected to another terminal of each of the first switch through the third switch, wherein one terminal of the first switch is connected to an R data signal terminal, one terminal of the second switch is connected to a G data signal terminal, and one terminal of the third switch is connected to a B data signal terminal.

40. The device of claim 26, wherein, in a normal mode, the timing controller outputs the first clock signal that is the same as the third clock signal and the second clock signal that is the same as the fourth clock signal, and wherein, in a multisync mode, the timing controller outputs the first clock signal that is the same as the fourth clock signal and the second clock signal that is the same as the third clock signal.

* * * * *